United States Patent [19]

Lipp

[11] Patent Number: 4,894,981

[45] Date of Patent: Jan. 23, 1990

[54] SUSPENSION CABLE CASING SYSTEM

[76] Inventor: Xaver Lipp, Hohenstaufenstrasse 30, 7090 Ellwangen, Fed. Rep. of Germany

[21] Appl. No.: 278,793

[22] Filed: Dec. 2, 1988

Related U.S. Application Data

[62] Division of Ser. No. 76,722, Jul. 23, 1987, Pat. No. 4,821,501.

[30] Foreign Application Priority Data

Aug. 8, 1986 [DE] Fed. Rep. of Germany ..... 3626886

[51] Int. Cl.[4] ..... B21C 37/12; B21D 39/02; D07B 1/16

[52] U.S. Cl. ..... 57/10; 29/33 D; 57/3; 57/6; 57/31

[58] Field of Search ..... 57/1, 3, 6, 9, 10, 18, 57/31, 906; 72/176, 177, 367; 29/33 D, 33 E, 728, 780, 788

[56] References Cited

U.S. PATENT DOCUMENTS

| | | | |
|---|---|---|---|
| 2,258,508 | 10/1941 | Kerchner | 57/235 X |
| 2,388,018 | 10/1945 | Stover | 57/10 |
| 3,204,666 | 9/1965 | Lindsay et al. | 138/135 |
| 3,359,822 | 12/1967 | Hurlon | 138/134 X |
| 3,566,643 | 3/1971 | Westerbarkey . | |
| 3,789,594 | 2/1974 | Rees | 57/10 |
| 3,865,146 | 2/1975 | Meserole | 138/135 X |
| 4,282,398 | 8/1981 | Solomon | 57/235 X |
| 4,358,064 | 11/1982 | Garneau | 57/10 X |
| 4,630,650 | 12/1986 | Davis | 138/135 X |
| 4,718,965 | 1/1988 | Finsterwalder et al. | 14/135 X |
| 4,724,596 | 2/1988 | Pavlyak | 138/135 X |
| 4,738,008 | 4/1988 | Proctor | 29/33 D |

FOREIGN PATENT DOCUMENTS

| | | | |
|---|---|---|---|
| 2529925 | 12/1976 | Fed. Rep. of Germany . | |
| 2722227 | 11/1978 | Fed. Rep. of Germany | 138/135 |
| 3437350 | 3/1986 | Fed. Rep. of Germany . | |
| 16651 | of 1905 | United Kingdom | 29/435 |

*Primary Examiner*—Donald Watkins

*Attorney, Agent, or Firm*—Roylance, Abrams, Berdo & Goodman

[57] ABSTRACT

A suspension cable is encased in a metal pipe formed from a metal strip wound in a series of adjacent helical windings on the cable. The longitudinal edges of adjacent windings are connected by a continuous tight fold.

15 Claims, 3 Drawing Sheets

SUSPENSION CABLE CASING SYSTEM

This is a division of application Ser. No. 07/076,722 filed July 23, 1987, U.S. Pat. No. 4,821,501.

FIELD OF THE INVENTION

The present invention relates to a suspension cable or a guy wire with a casing. The invention also includes a process and an apparatus for producing of an encased cable in situ.

BACKGROUND OF THE INVENTION

Suspension cables used for construction, especially for suspension bridges, have long been provided with plastic casings for protection against corrosion. However, it has been suggested that plastic casings do not withstand harmful atmospheric influences for a sufficiently long time, especially in crowded urban or industrial areas. Plastic covers also do not have sufficient resistance against ultraviolet rays. With a significant number of older suspension and structural edifices, the existing plastic-covered cables are now ready for reconditioning.

Reconditioning by providing the cable with a metal casing in the form of a tight pipe of a corrosion-resistant material surrounding the cable offers an essentially permanent protection for suspension cables or guy wires. However, ends are not free with built-in cable construction in already existing suspension wires of edifices. Thus, it is not possible to fit pipe casings in existing construction.

SUMMARY OF THE INVENTION

An object of the present invention is to provide a remedy whereby cables which are already used as suspension wires or are built into edifices can be provided with a permanent metal casing, without dismounting or removing the present cable or freeing a cable end.

Another object of the present invention is to provide an encased suspension cable assembly, and a process and apparatus for producing the encased suspension cable, wherein an existing cable structure can be encased in metal efficiently in situ.

The foregoing objects are attained according to the present invention by producing a casing shaped as a metal pipe and formed from a metal strip helically wound about the cable with adjacent windings coupled by a tight fold connecting longitudinal edges of adjacent windings. Thus, a suspension cable or guy wire is obtained which has a metal casing. If a suitable metal is used for the metal strip forming the casing pipe, for example, copper, high-grade steel or the like, the cable is permanently protected from damaging atmospheric conditions. The metal strip forming the casing pipe can also be provided with an additional protective coating, for example, a tin coating or a zinc coating. The invention permits forming a metal pipe encasing the cable on the cable itself. Even a cable, attached at both ends and built into the suspension or structural edifice, can be provided with a metal protective pipe.

In producing the fold tightly connecting the edges of the adjacent windings of the metal strip with each other, a packing element, for instance a packing strip, extending the length of the fold, can be inserted between the tightly engaging surfaces of the fold. With careful construction of the fold with traditional fold techniques, example, with a double fold or a curled fold, complete tightness or security of the fold can be attained without use of additional packing elements.

An elastic flexibility of the casing lengthwise and traverse to the pipe, for example, to allow for heat expansion, can be attained by means of a deformable area extending lengthwise along the metal strip and deformable transverse to the strip. It is especially advantageous that a portion of the fold itself serve as the deformable area. However, a special stiffening corrugation can also be provided, extending lengthwise along the metal strip, for formation of the deformable area.

In one especially advantageous exemplary embodiment, the edges of the windings of the metal strip are connected with each other by a double fold. The double fold consists of five adjacent layers, of which three layers are formed of segments of the edge of one strip and two layers are formed of segments of the edge of the adjacent strip. A double fold of this type, when completed, forms a rib projecting essentially radially form the casing outer surface, and can be pressed together with a force exerted essentially lengthwise or longitudinally along the casing. This can be important if the cable is surrounded with a relatively soft material such as when the cable is covered by a winding of a rubber strip, on the outside of which rubber strip rests the metal casing pipe.

The present invention also relates to a process for producing a metallic casing in the form of a metal pipe about a cable. A metal strip is wound helically with adjacent windings around the cable. The longitudinal edges of adjacent windings of the strip are held together by formation of a tight fold extending along the length of the strip continuously without interruption.

The metal strip can be wound directly on the cable or on a flexible material surrounding the cable, for example, a rubber or plastic strip cemented around the cable. However, the encasing pipe can also be made so that its inside diameter is larger than the outside diameter of the cable, and an intermediate space is thus left between the cable and the metal casing. A partitioned sheathing then can be used with such embodiment of the process, wherein the sheathing wall thickness is adapted to the unobstructed width of the intermediate space between cable and pipe. The partitioned sheathing is used as a movable winding mandrel on the cable on which the metal strip is wound. The intermediate space formed between cable and casing can be filled subsequently with a flexible filler material. Before the filling, the casing can be tested for a gas-tightness by a pressure test in which the intermediate space is filled with a pressurized gas.

The present invention also relates to an apparatus for producing a metal casing on a suspension cable or guy wire. The apparatus according to the present invention has a partitioned or separable, rotatable winding member surrounding the cable. The winding member supports a feed roll of the metal strip from which the casing or pipe is wound. Strip guiding, strip profiling and folding tools are connected with the winding member. Upon rotary movement of the winding member around the cable to be encased, the revolving tools supply the strip tension required for the winding.

In one advantageous exemplary embodiment of the apparatus, an electric motor drive is provided to produce the rotary movement of the winding member. The non-rotating part of the apparatus supports the drive, is movable along the cable length with the winding member, and is stayed against the reaction torque produced by the drive, for example, by a stabilizing weight or a brace propped on an adjacent cable extending into the vicinity of the cable on which the winding process is being carried out.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Figure 1:
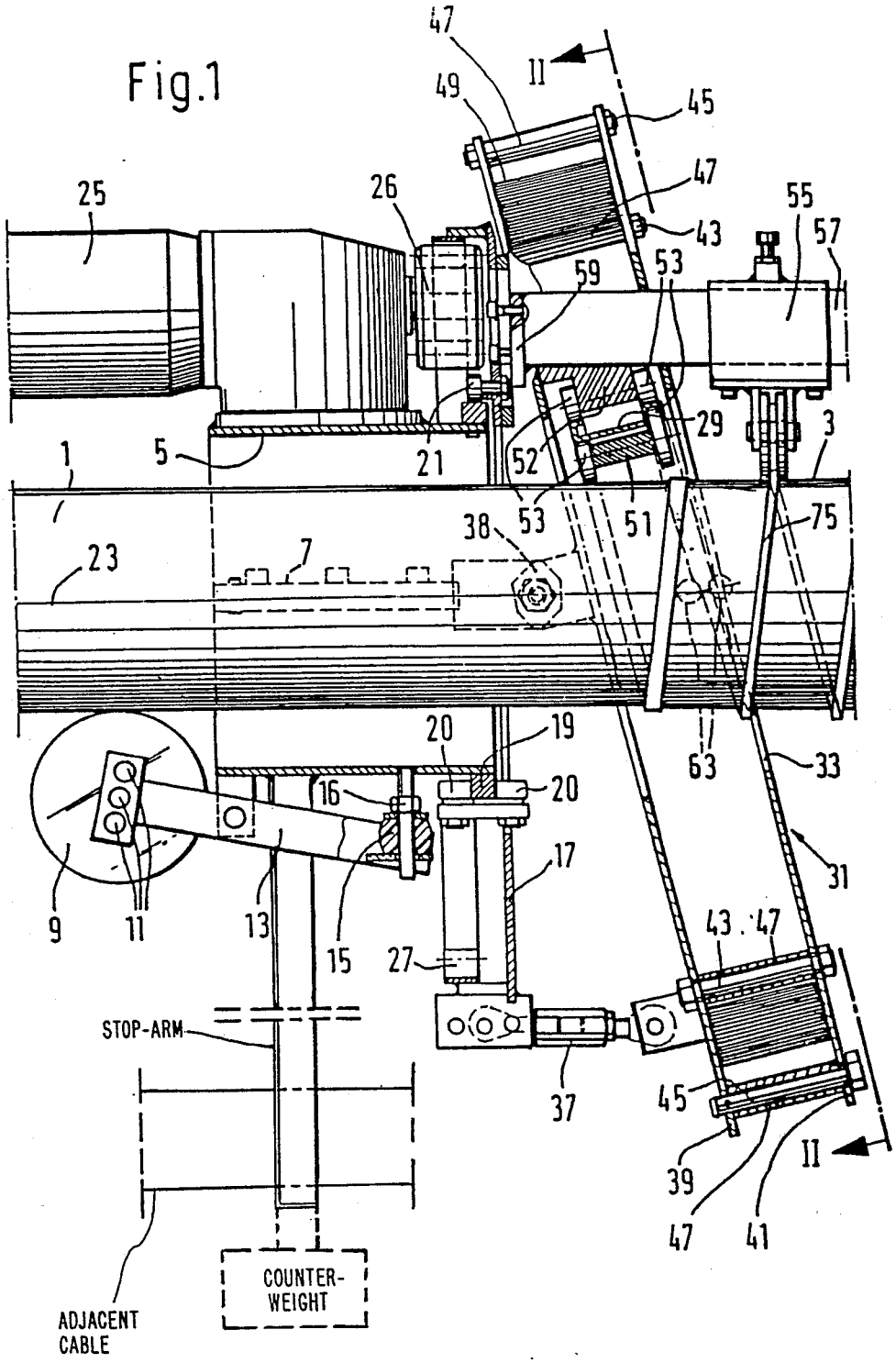
FIG. 1 is a side elevational view in section of an exemplary embodiment of an apparatus for producing, a metal casing on a cable according to the present invention.
Figure 2:
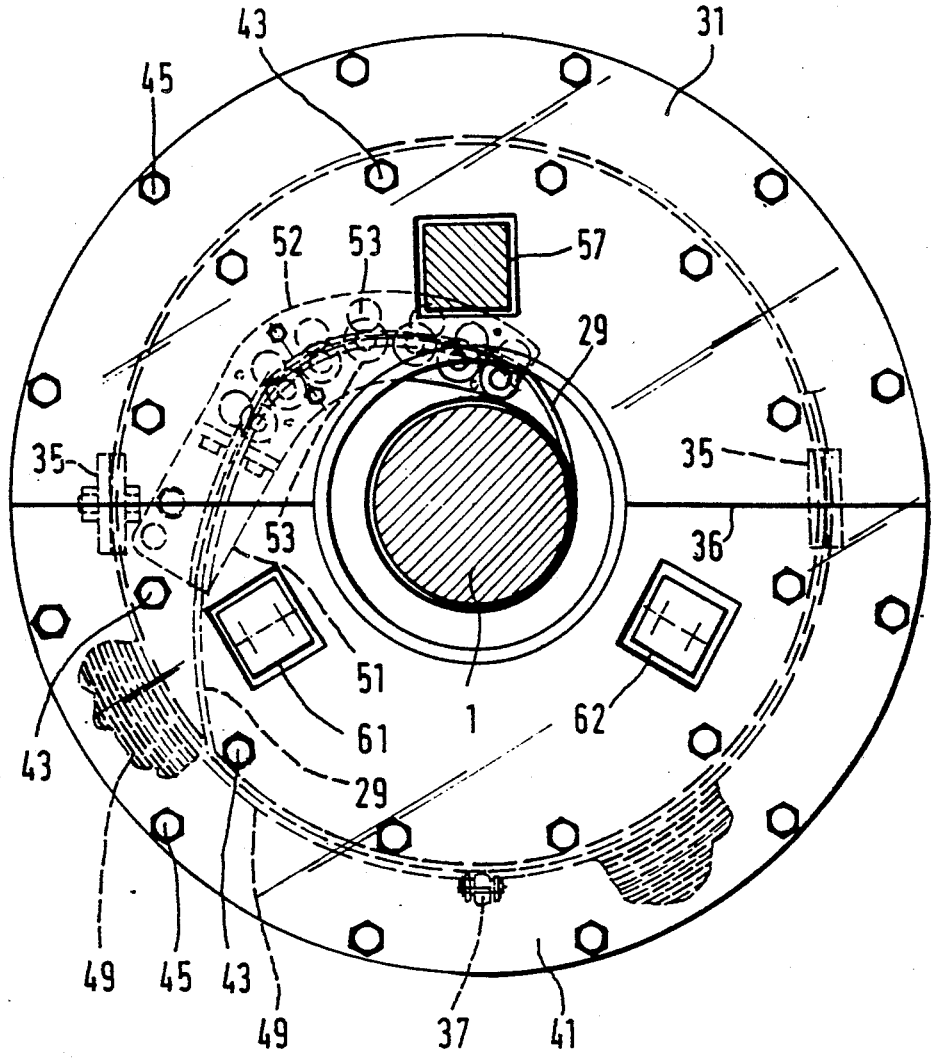
FIG. 2 is a front elevational view of the winding frame of the apparatus in section taken along line II—II of FIG. 1.

The drawings show a suspension cable 1 in an already existing suspension bridge. An apparatus forming a part of the present invention provides cable 1 with a metal casing in the form of a pipe 3 tightly surrounding cable 1. The essential parts of the apparatus are shown in FIGS. 1 and 2.

The apparatus comprises an outer cover 5 configured as a hollow metal housing and divided into two housing halves so that it can be placed on both sides of the tensioned cable 1. The housing halves can be screwed together along a fixing flange 7 indicated in FIG. 1 with broken lines. Outer cover 5 is supported by a plurality of tensioning and guide rollers 9, only one of which is illustrated in Figure 1, for sliding longitudinally on cable 1. For adaption to different cable diameters, the rollers 9 can be mounted at different bearing points 11 on a relevant supporting arm 13. Arm 13 in turn can be pivoted on outer cover 5 and is propped on or biased by a spring element 15 on outer cover 5. The position of roller 9 and the force of the spring bias of spring element 15 pressing roller 9 against cable 1 can be set by a set nut 16.

A bearing 17 is rotatably mounted on outer cover 5 and is ring shaped. The baring is likewise partitionable or separable in two halves, and is mounted on a bearing ring 19 concentric to the housing of outer cover 5. A plurality of pairs of rollers 20 on outer cover 5 serve as axial guides, while a plurality of rollers 21 serve as radial guides. Of rollers 21 mounted rotatably on bearing 17 and the pairs of rollers 20, only one of each is shown in FIG. 1. Since bearing ring 19 is concentric to the housing of outer cover 5 and outer cover 5 is guided concentric to cable 1 by means of rollers 9, the rotational axis of bearing 17 and the longitudinal axis 23 of cable 1 are identical or coextensive.

A power transmission motor 25 is mounted to the side of outer cover 5 as a drive to produce the rotary movement of bearing 17. The pinion 26 of motor 25 meshes with an inside toothed rim 27 of bearing 17. The numbers of teeth of pinion 26 and toothed rim 27 and the power transmission foundation of drive motor 25 are selected so that bearing 17 can be driven at a rotational speed which is suitable for a winding process, wherein a metal strip 29 is wound around cable 1. This winding of metal strip 29, as explained in more detail hereinafter, forms the metal pipe 3 surrounding cable 1 from metal strip 29.

A winding member is tightly or fixedly connected with bearing 17. In the present exemplary embodiments, the winding member is circular, ,and is configured as one entirety with winding frame 31. Winding frame 31 surrounds cable 1 essentially concentrically, which cable extends through a round inside opening 33 of winding frame 31. Winding frame 31, similar to outer cover 5 and bearing 17, is likewise subdivided, so that it can be fitted onto a relevant cable 1 supported and tensioned on both ends. The halves of winding frame 31 can be screwed together by means of fixing flanges 35 shown in FIG. 2.

Winding frame 31 is arranged at an angle of inclination relative to the rotational plane of bearing 17. This supports metal strip 29 at the angle of inclination such that the strip can be wound helically in adjacent windings around cable 1. The angle of inclination can be set by adjustable connecting links 37 and 38 connecting winding frame 31 with bearing 17 (FIG. 1).

When assembled, winding frame 31 has two parallel disks 39 and 41 connected by inside tie bolts 43 and outside tie bolts 45 circumferentially spaced around the periphery of the winding frame. Sheathings 47 supported on the tie bolts 43 and 45 hold disks 39 and 41 at a distance from each other corresponding essentially to the width of the smooth or flat, untreated metal strip 29. Feed roll 49 of the still smooth, flat untreated metal strip 29 is placed in the annular space between inside bolts 43 and outside bolts 45. Sheathings 47 of inside bolts 43 support feed roll 49.

Figure 3:
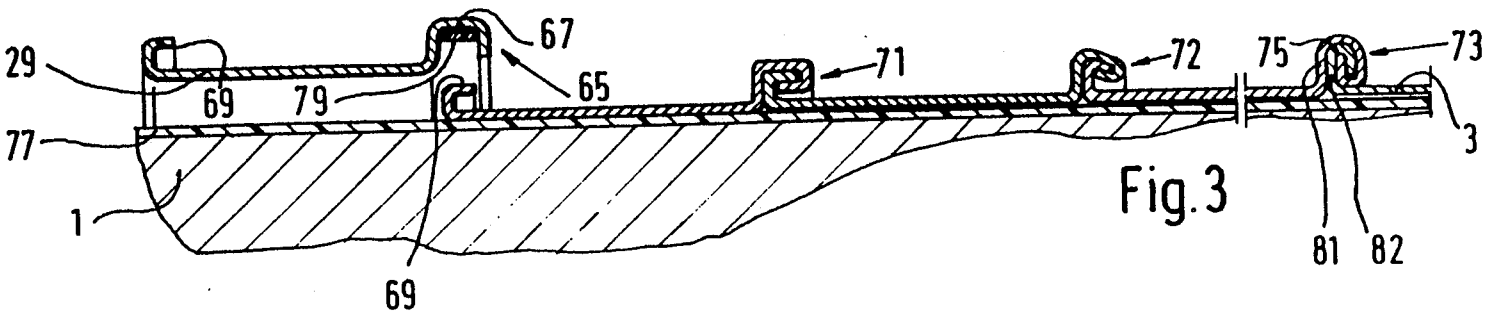
FIG. 3 is a side elevational view in section of a cable with a partially completed casing according to the present invention.

As shown in FIG. 2, metal strip 29 is conveyed to the periphery of cable 1 for winding from the innermost winding of feed roll 49 over strip guide comprising two curved guide cleats 51 and 52. A plurality of bending rollers 53 are mounted on cleats 51 and 52, which bending rollers forming a profiling station. The bending rollers 53 profile the strip 29 on both longitudinal edges 67 and 69 (FIG. 3), while it is passing through, forming a plurality of stepped bends shown at the far left in FIGS. 3 and 4. As a result of this profiling of the longitudinal edges of strip 29, the strip 29 is prepared for forming a double fold 75 (FIG. 3). By this folding operation, the adjacent helical windings of strip 29 being wound around cable 1 are connected with each other, so that the closed metal pipe 3 on cable 1 serves as a casing.

Double fold 75 is produced in the present example in three steps with three folding tools, of which only one is shown completely in FIG. 1 and is identified as 55. This folding tool 55 is arranged adjustably on a support 57. One end 59 of support 57 can be screwed together with bearing 17. Supports 61 and 62 for the other folding tools, of which one is shown in broken line as 63 in FIG. 1, are indicated diagrammatically in FIG. 2.

FIG. 3 shows the individual folding steps at 71, 72 and 73 in detail, as they are carried out for the formation of metal pipe 3. As profiled strip 29 passes through the apparatus, its profiled longitudinal edge 67, shown at the right in the drawing, is wound over the left-side profiled longitudinal edge 69 of the previously laid winding at 65, in order to prepare the fold during the winding process. The first stage in forming the fold results in the state following the first fold step, as indicated at 71 in FIG. 3. The configuration of the fold following the second fold step is shown at 72. Finally, FIG. 3 shows the completed double fold 75 at 73.

The pressure force required to produce a complete tight fold, by which the double fold 75 is pressed together, must aligned along the outside of the pipe. There must be no radial force applied to the outside of metal pipe 3 while the fold is being produced. It is especially preferred then to coat cable 1 on its periphery with a flexible material, for example, with a rubber strip 77 or a plastic strip wound around the cable as shown in FIG. 3. By producing the fold without radial pressure or force acting along pipe 3 on strip 77, no danger exists that the flexible inside casing formed by strip 77 be penetrated.

FIG. 3 shows a packing strip 79 on the left most winding of metal strip 29 serving as a packing element inserted inside profiled longitudinal edge 67. To facilitate viewing of the drawing, the packing strip is removed at points 71, 72 and 73. However, with careful formation of double fold 75, complete tightness or sealing can also be attained without insertion of a sealing or packing strip.

With use of a double fold 75, a rib projects radially outwardly on the outside of pipe 3. Fold 75 can form a deformable area allowing for heat expansions of pipe 3. An outside layer 81 of fold 75 in FIG. 3 is propped up or biased from the adjacent layer 82 very slightly, i.e., within the limits of elasticity. Length modifications of pipe 3 can be compensated by elastically flexible, sharp back and forth movements of layers 81 and 82 of each fold 75 or by closer proximity of layers 81 and 82.

Figure 4:
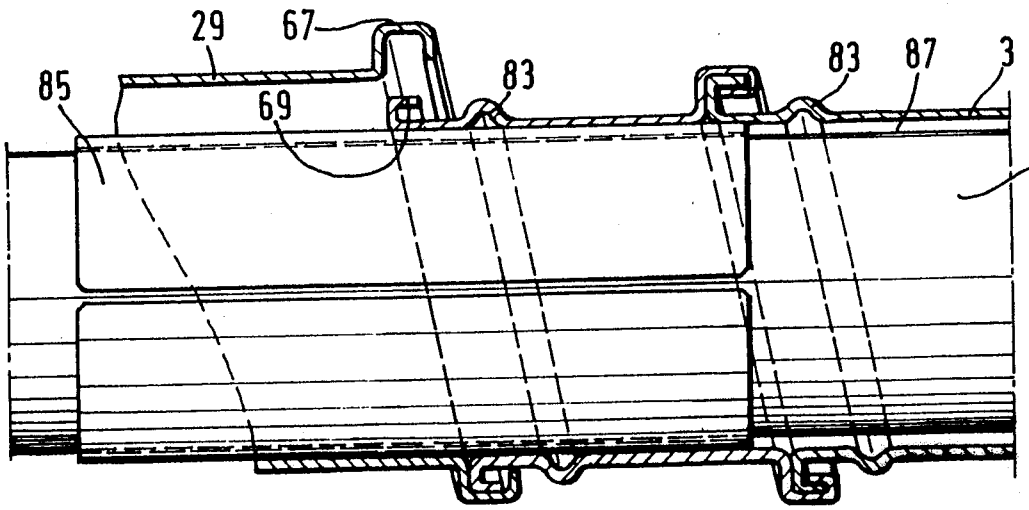
FIG. 4 is a side elevational view in section similar to FIG. 3, in which the casing has an inside diameter larger than the outside diameter of the cable according to another embodiment of the present invention.

FIG. 4 shows a stiffening corrugation 83 forming another possible deformable area. Stiffening corrugation 83 is produced in metal strip 29 during its passage through the set of rollers 53 in the profiling station as longitudinal edges 67 and 68 are profiled.

FIG. 4 also shows the use of a partitioned sheathing 85 as a movable winding mandrel. Sheathing 85 is thrust lengthwise or longitudinally along cable 1 during the winding process so that pipe 3 formed from winding metal strip 29 has an inside diameter corresponding to the outside diameter of sheathing 85. Between cable 1 and pipe 3 is an intermediate space 87 forming an unobstructed passage corresponding to the wall thickness of sheathing 85. This intermediate space 87 is subsequently filled with a flexible filler material, following a pressure test, in which pressure test intermediate space 87 is filled with a pressurized gas and the completed pipe 3 is tested for gas tightness.

In the operation of the apparatus shown in FIGS. 1 and 2, feed roll 49 of metal strip 29 is used for forming metal pipe 3. Metal strip 29 can be copper or high-grade steel or the like. Inside bolts 43 of winding frame 31 and their sheathings 47 permit forming of roll 49 from strip 29 by winding the strip from the outside following removal of outside bolts 45 and their sheathings 47. Winding frame 31 is set at an angle of inclination or angled axis relative to axis 23, around which angled axis the winding frame rotates during the winding process. The angled axis corresponds to the pitch angle of the helical windings of strip 29 laid around cable 1. By adjustment of the adjustable connecting links 37 and 38, the angle of inclination is varied. The angle of inclination is set according to the diameter of cable 1 and the width of the windings, i.e., the width of strip 29 which is being used.

Strip 29 runs from the innermost winding of feed roll 49 through the strip guide cleats 51 and 52 and through the profiling station formed by bending rollers 53 to the periphery of cable 1. The strip is laid out at that site in adjacent windings by the rotary movement of winding frame 31. The longitudinal edges are folded together by the folding tools, shown in FIG. 1 as folding tool 55. This folding tool 55 also serves in a certain way as guide member. The tool is thrust through the formed and completed fold 75 along cable 1 during the rotary movement corresponding to the screw thread pitch. The apparatus mounted movably by rollers 9 on cable 1 is moved lengthwise. The tensile stress required in strip 29 for the winding process is obtained during the winding process by the friction forces which the strip guide and handling devices, including sheathings 47 supporting the innermost winding of roll 49, guide cleats 51, 52 and bending rollers 53, exert on strip 29 as it moves relative to these members.

The counterrotational torque produced on outer cover 5 of the apparatus by the drive force of power transmission motor 25 is compensated by a not shown counterweight connected with outer cover 5. In some cases, such as is generally the case with a suspension bridge, at least one other suspension cable runs adjacent to the cable 1 which is to be encased. For bracing against the torque, a crosstie rod can also be provided extending from outer cover 5, which crosstie rod is guided slidably on the other cable supporting it.

For encasing a long cable 1, a new roll of strip 29 is wound on sheathings 47 of bolts 43 to resupply feed roll 49. The beginning of the innermost winding of the new feed roll is fastened at its truncated end to the strip end of the preceding strip by brazing. An uninterrupted metal pipe 3 of any desired length can be produced in this manner.

When a plurality of strip guide devices, profiling stations and folding stations are arranged offset from one another on the winding frame, then a metal pipe consisting of a plurality of metal strips can be produced. Thus a plurality of windings are produced on the cable with each revolution of the winding frame and are connected with each other by folding.

While various embodiments have been chosen to illustrate the invention, it will be understood by those skilled in the art that various changes and modifications can be made therein without departing from the scope of the invention as defined in the appended claims.

What is claimed is:

1. An apparatus for producing a metal casing on a suspension cable, comprising:

an outer cover having guide means for sliding longitudinally on a cable to be encased;

a winding member rotatably mounted on said outer cover for rotation about a rotary axis coinciding with a longitudinal axis of the cable, said winding member having a frame for partially surrounding the cable and having a periphery with supply means for holding a feed roll including a supply of metal strip, said winding member surrounding the cable as a ring;

strip handing means, mounted on the winding member, for feeding the metal strip during rotation of said winding member from an inside winding of said feed roll to and around a periphery of the cable; and strip working means, mounted on the winding member, including a profiling means arranged on a strip movement path from said feed roll to the cable periphery, said profiling means including bending tools for outwardly bending and profiling longitudinal edges of the metal strip out from a plane of the metal strip, and folding tools for folding adjacent profiled longitudinal edges together of adjacent metal strip windings.

2. An apparatus according to claim 1 wherein said winding member includes an annular winding frame having a peripheral area with a pin to hold the strip feed roll, said winding frame being mounted rotatably and axially immovably on said outer cover for the rotary movement around the rotary axis, adjustable connecting links variably setting an angle of inclination between an outer cover bearing and said winding frame to vary pitch angles of helical windings of the strip wound around the cable.

3. An apparatus according to claim 2 wherein said folding tools are mounted on supports extending along the cable on a side of the said winding frame turned away from said connecting links and said outer cover bearing.

4. An apparatus according to claim 2 wherein said outer cover bearing comprises a power transmission connection with a drive mounted on the outer cover to produce the rotary movement.

5. An apparatus according to claim 4 wherein said outer cover bearing has a toothed rim meshing with a pinion of an electric power transmission motor provided on the outer cover.

6. An apparatus according to claim 1 wherein said guide means comprise guide rollers mounted adjustably on said outer cover for adaption to different cable diameters.

7. An apparatus according to claim 6 wherein said outer cover comprises a stop element receiving reaction torque produced by a drive.

8. An apparatus according to claim 7 wherein a counterweight is supported on an adjacent cable extending next to the cable to be encased.

9. An apparatus according to claim 1 wherein a sheathing having an inside diameter larger than an outside diameter of the cable is slidable longitudinally on the cable with said winding member and serves as a winding mandrel on which the metal strip can be wound.

10. An apparatus for producing a metallic casing in the form of a metal pipe about a cable, comprising:

feed roll means for supplying a metal strip having a deformable area extending longitudinally along the strip;

winding means, coupled to said feed roll means, for helically winding the metal strip about a suspension cable in adjacent windings; and bending means, coupled to said winding means, for forming tight folds in longitudinal edges of the strip connecting the adjacent windings together continuously without interruption along the length of the strip.

11. An apparatus according to claim 10 wherein said bending means comprises means for profiling longitudinal edges of the strip and bending the edges out of a plane containing a central portion of the strip to adapt the longitudinal edges for the fold to be formed, before the strip is wound on the cable.

12. An apparatus according to claim 11 wherein said bending means comprises fold forming means for applying a folding force essentially longitudinally of the cable.

13. An apparatus according to claim 10 wherein said feed roll means comprises means for providing flexible material on the cable before winding of the metal strip.

14. An apparatus according to claim 10 wherein said winding means winds the metal strip around the cable in windings having an inside diameter greater than an outside diameter of the cable defining an intermediate space between the casing and the cable, and includes filling means for filling the intermediate space with flexible material.

15. An apparatus according to claim 14 wherein said filling means places a sheathing on the cable such that the sheathing is forced axially on the cable at the winding point of the metal strip.

* * * * *